US009370245B2

(12) United States Patent
Fafard et al.

(10) Patent No.: US 9,370,245 B2
(45) Date of Patent: Jun. 21, 2016

(54) AUTOMATICALLY ADJUSTABLE SEAT

(71) Applicant: Chaparral Boats, Inc., Nashville, GA (US)

(72) Inventors: Michael J. Fafard, Nashville, GA (US); James S. Phares, Farmington Hills, MI (US); Raymond L. Tanguay, Nashville, GA (US); Steven C. Flowers, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 189 days.

(21) Appl. No.: 14/249,156

(22) Filed: Apr. 9, 2014

(65) Prior Publication Data

US 2014/0300153 A1 Oct. 9, 2014

Related U.S. Application Data

(63) Continuation of application No. 12/989,195, filed as application No. PCT/US2009/040344 on Apr. 13, 2009, now abandoned, which is a continuation of application No. 12/107,459, filed on Apr. 22, 2008, now abandoned.

(51) Int. Cl.

| | |
|---|---|
| ***A47C 1/032*** | (2006.01) |
| ***A47C 11/00*** | (2006.01) |
| *B63B 29/04* | (2006.01) |

(52) U.S. Cl.

CPC ..... *A47C 1/032* (2013.01); *A47C 1/03211* (2013.01); *A47C 11/00* (2013.01); *B63B 2029/043* (2013.01)

(58) Field of Classification Search

CPC ..... B63B 29/04; B63B 2029/043
USPC ..... 297/63, 64, 65, 244
See application file for complete search history.

(56) References Cited

U.S. PATENT DOCUMENTS

| | | | |
|---|---|---|---|
| 2,993,529 | A | 7/1961 | Brown |
| 3,095,234 | A | 6/1963 | Brooks et al. |
| 3,394,417 | A | 7/1968 | O'Link |

(Continued)

FOREIGN PATENT DOCUMENTS

| | | |
|---|---|---|
| JP | 06-015556 | 3/1994 |
| JP | 08-242973 | 9/1996 |
| KR | 20-0231430 | 7/2001 |

OTHER PUBLICATIONS

Notification of Transmittal of the International Search Report and the Written Opinion of the International Searching Authority, or the Declaration, PCT Application No. PCT/US2009/040344, dated Nov. 30, 2009, 11 pages.

*Primary Examiner* — Sarah McPartlin
(74) *Attorney, Agent, or Firm* — Fish & Richardson P.C.

(57) ABSTRACT

Automatically adjustable seating apparatus are described. The automatically adjustable seating apparatus include first and second seat bottom portions that at least one of which is moveable. The first and/or second seat bottom portions are moveable by automatic adjusters that alter the position of a seat bottom portion between a retracted position and an extended position. When the moveable seat bottom portion or portions are in their retracted position, the automatically adjustable seating apparatus is configured as two seats back-to-back, and when the seat bottom portion or portions are in their extended positions, the automatically adjustable seating apparatus forms a substantially flat surface.

19 Claims, 8 Drawing Sheets

(56) References Cited

U.S. PATENT DOCUMENTS 3,910,630 A 10/1975 Runyon et al.
4,544,199 A 10/1985 Wrigley
4,637,081 A 1/1987 Clark
6,390,554 B1 5/2002 Eakins et al.
6,883,458 B2 4/2005 Huse

AUTOMATICALLY ADJUSTABLE SEAT

CROSS-REFERENCE TO RELATED APPLICATIONS

This application is a continuation, and claims priority, of co-pending U.S. application Ser. No. 12/989,195, filed Dec. 22, 2010, which is a filing under 35 U.S.C. §371 based on PCT/US2009/040344 filed Apr. 13, 2009, which claims priority to U.S. patent application Ser. No. 12/107,459 filed Apr. 22, 2008. The contents of all of the prior applications are incorporated herein by reference in their entirety.

SUMMARY

Automatically adjustable seating apparatus are described. The first automatically adjustable seating apparatus includes a frame, a first seat bottom portion, and a second seat bottom portion. The first and second seat bottom portions are slideably attached to the frame and are moveable by automatic adjusters to alter the position of the seat bottom portions between retracted positions and extended positions. When the first seat bottom portion and second seat bottom portion are in their retracted positions, the automatically adjustable seating apparatus is configured as two seats back-to-back, and when the first seat bottom portion and second seat bottom portion are in their extended positions, the automatically adjustable seating apparatus forms a substantially flat surface.

A second automatically adjustable seating apparatus is also described. The second automatically adjustable seating apparatus includes a frame, a first seat bottom portion, and a second seat bottom portion. The first seat bottom portion is slideably attached to the frame and is moveable by an automatic adjuster to alter the position of the first seat bottom portion between a retracted position and an extended position. The position of the second seat bottom portion is fixed. When the first seat bottom portion is in its retracted position, the second automatically adjustable seating apparatus is configured as two seats back-to-back, and when the first seat bottom portion is in its extended position, the second automatically adjustable seating apparatus forms a substantially flat surface.

The details of these and other embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
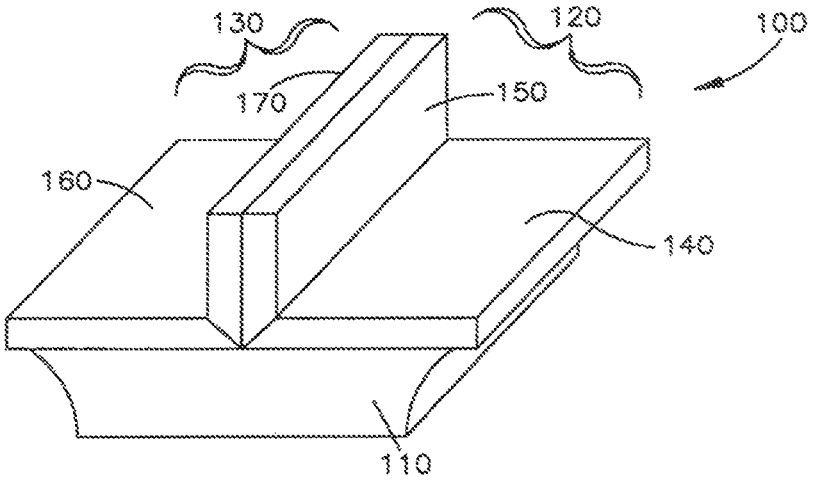
FIGS. 1A, 1B, and 1C are perspective views of an automatically adjustable seating apparatus configured as two seats back-to-back (FIG. 1A), in an intermediate position between a retracted position and an extended position (FIG. 1B), and configured as a substantially flat surface (FIG. 1C).

Au automatically adjustable seating apparatus is described. The term automatically adjustable, when used to described the seating apparatus, is intended to mean that the seat is not manually adjusted by an operator, i.e., no physical pushing or pulling of the seat is required by the operator. Rather, the seat is automatically adjusted through an interaction with a controller that controls the seat position. The automatically adjustable seating apparatus can be configured, in a first arrangement, as two seats arranged back-to-back. The two seats have bottom portions and back portions. The two seat bottom portions are slideably attached to a frame and are moveable by automatic adjusters between retracted positions and extended positions. When both bottom portions are in their retracted positions, the automatically adjustable seating apparatus is configured as two seats back-to-back. When both bottom portions are in their extended positions, the automatically adjustable seating apparatus is configured as a substantially flat surface.

A second automatically adjustable seating apparatus is also described. The second automatically adjustable seating apparatus can be configured, in a first arrangement, as two seats arranged back-to-back. The two seat portions have bottom portions and back portions. The first seat bottom portion is slideably attached to a frame and is moveable by an automatic adjuster between a retracted position and an extended position. When the first seat bottom portion is in the retracted position, the second automatically adjustable seating apparatus is configured as two seats back-to-back. When the first seat bottom portion is in the extended position, the second automatically adjustable seating apparatus is configured as a substantially flat surface.

As shown in FIGS. 1A-C and FIGS. 2A-C, an automatically adjustable seating apparatus 100 comprises a base portion 110, a first seat 120, and a second seat 130. The first seat 120 is formed by a first seat bottom portion 140 and a first seat back 150. The second seat 130 is formed by a second seat bottom portion 160 and a second seat back 170. The first seat bottom portion 140, the first seat back 150, second seat bottom portion 160, and second seat back 170 can be ergonomically shaped to adapt to the preference of a user or the intended environment in which the automatically adjustable seating apparatus will be used. For example, the first seat back 150 and second seat back 170 could be high to provide head and neck support or low if such support is not needed in a particular application. Further, the first seat bottom portion 140, the first seat back 150, second seat bottom portion 160, and second seat back 170 can be made from materials suitable for the environment in which they will be used, i.e., if the automatically adjustable seating apparatus is to be used in a marine environment, materials resistant to degradation by water and/or salt can be used. For further example, the first seat bottom portion 140, the first seat back 150, second seat bottom portion 160, and second seat back 170 can be formed of shaped foam and covered with an outer covering material such as a vinyl, polyurethane, or fabric. The width of the automatically adjustable seating apparatus 100 can vary from the width of a single seat to wide enough to seat several persons depending on the intended application. Additional components not shown in the drawings such as side bolsters can be utilized with the automatically adjustable seating apparatus 100.

The first seat back 150 has an upper portion 180 and a lower portion 190, and the first seat bottom portion 140 has a front portion 200 and a back portion 210. The lower portion 190 of the first seat back 150 is pivotally attached to the back portion 210 of the first seat bottom portion 140 along a first pivot attachment seam 220. The second seat back 170 also has an upper portion 230 and a lower portion 240, and the second seat bottom portion 160 also has a front portion 250 and a back portion 260. The lower portion 240 of the second seat back 170 is pivotally attached to the back portion 260 of the first seat bottom portion 160 along a second pivot attachment seam 270. The first seat back 150 is further pivotally attached at its upper portion 180 to the upper portion 230 of the second seat back 170 along a third pivot attachment seam 280. Each of the first pivot attachment seam 220, the second pivot attachment seam 270, and third pivot attachment seam 280 can comprise a pivot apparatus such as a single hinge or multiple hinges.

Figure 1B:
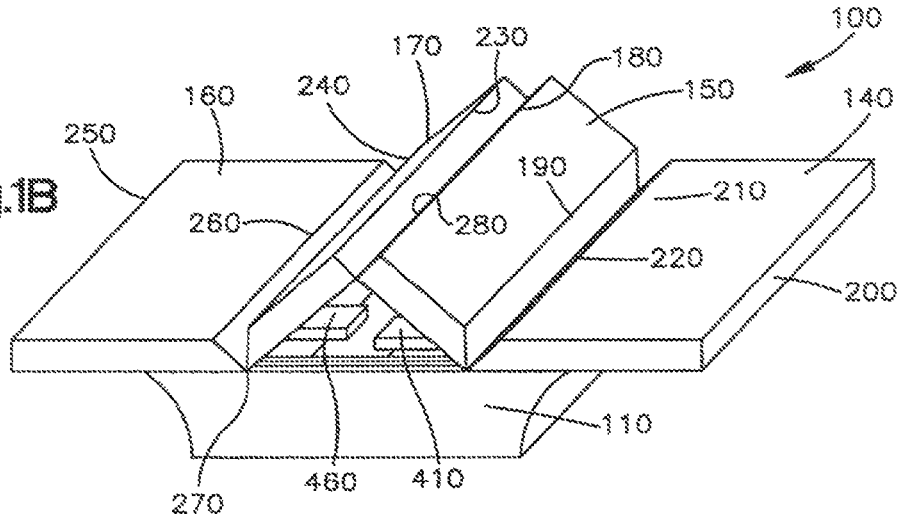
Figure 1C:
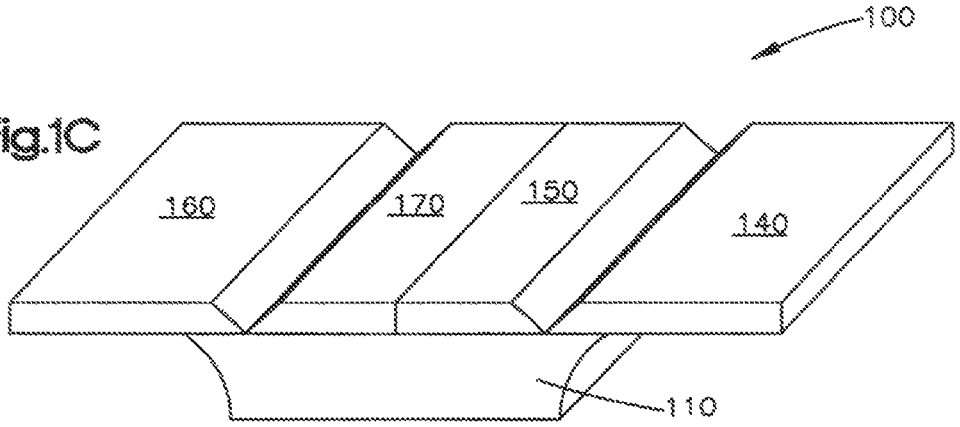
Figure 2A:
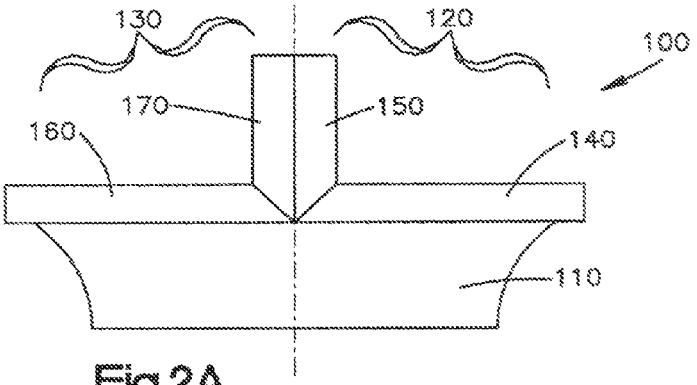
FIGS. 2A, 2B, and 2C are side views of an automatically adjustable seating apparatus configured as two seats back-to-hack (FIG. 2A), in an intermediate position between a retracted position and an extended position (FIG. 2B), and configured as a substantially flat surface (FIG. 2C).
Figure 2B:
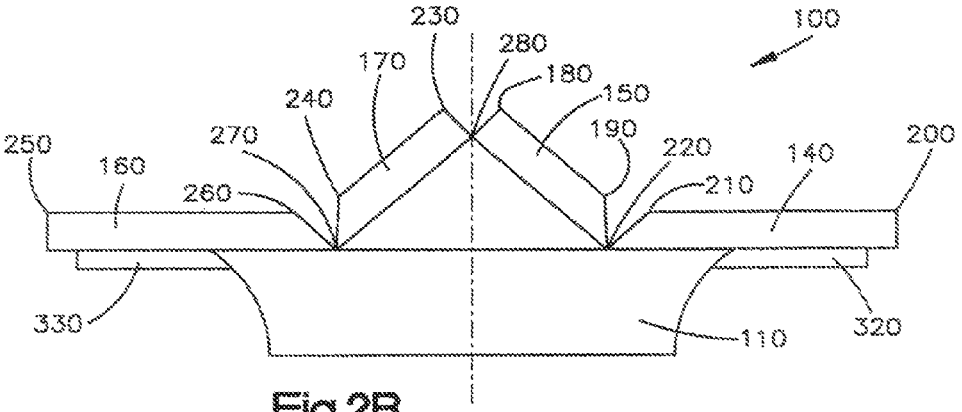
Figure 2C:
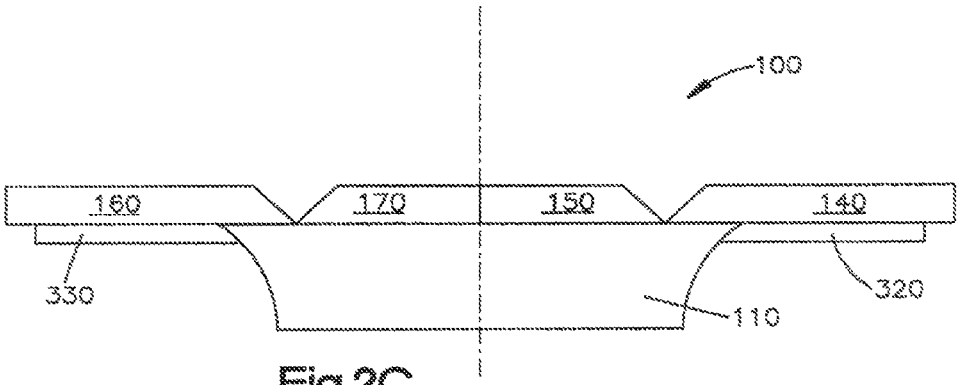

FIGS. 1A-C and 2A-C show the automatically adjustable seating apparatus configured as two seats back-to-back (FIGS. 1A and 2A), in an intermediate position between a retracted position and an extended position (FIGS. 1B and 2B), and configured as a substantially flat surface (FIGS. 1C and 2C). The first seat bottom portion 140 is extendable between a first seat bottom portion retracted position and a first seat bottom portion extended position. Similarly, the second seat bottom portion 160 is extendable between a second seat bottom portion retracted position and a second seat bottom portion extended position. FIGS. 1A and 2A show the first seat bottom portion 140 in the first seat bottom portion retracted position and the second seat bottom portion 160 in the second seat bottom portion retracted position, in which configuration the automatically adjustable seating apparatus 100 is configured as two seats back-to-back. FIGS. 1C and 2C show the first seat bottom portion 140 in the first seat bottom portion extended position and the second seat bottom portion 160 in the second seat bottom portion extended position, in which configuration the automatically adjustable seating apparatus is configured as a substantially flat surface. FIGS. 1B and 2B show the first seat bottom portion 140 and second seat bottom portion 160 in a position between their retracted and extended positions. The first seat bottom portion 140 and second seat bottom portion 160 are automatically adjustable between their retracted and extended positions depending on the devices used to adjust their positions. The maintenance of positions of the first seat bottom portion 140 and second seat bottom portion 160 between their retracted and extended positions is contemplated depending on the preference of a user making the adjustment. For example, the positions shown in FIGS. 1B and 2B may be adopted by a user in order to recline rather than sit upright (first seat bottom portion 140 and second seat bottom portion 160 fully retracted) or substantially lie flat (first seat bottom portion 140 and second seat bottom portion 160 fully extended).

Figure 3A:
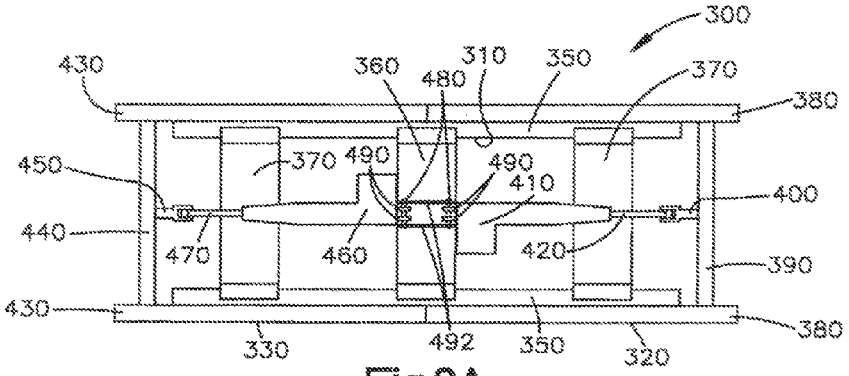
FIGS. 3A, 3B, and 3C are top views of a frame for use with the automatically adjustable seating apparatus shown in FIGS. 1 and 2 in the positions shown in FIGS. 1 and 2, i.e., with the automatically adjustable seating apparatus configured as two seats back-to-back (FIG. 3A), in an intermediate position between a retracted position and an extended position (FIG. 3B), and configured as a substantially flat surface (FIG. 3C).
Figure 3B:
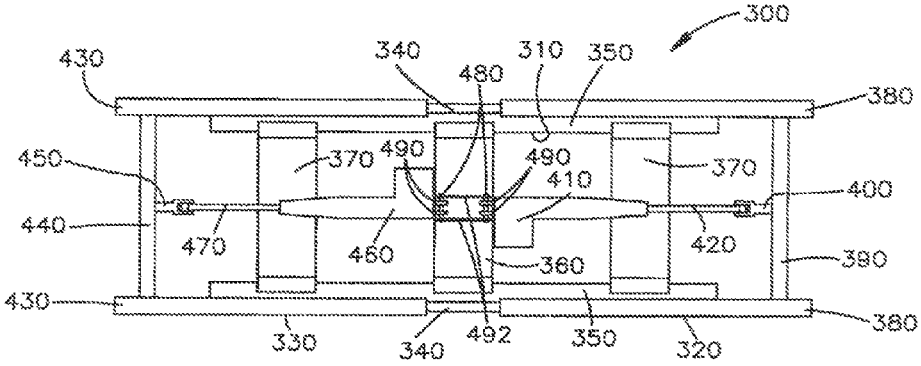
Figure 3C:
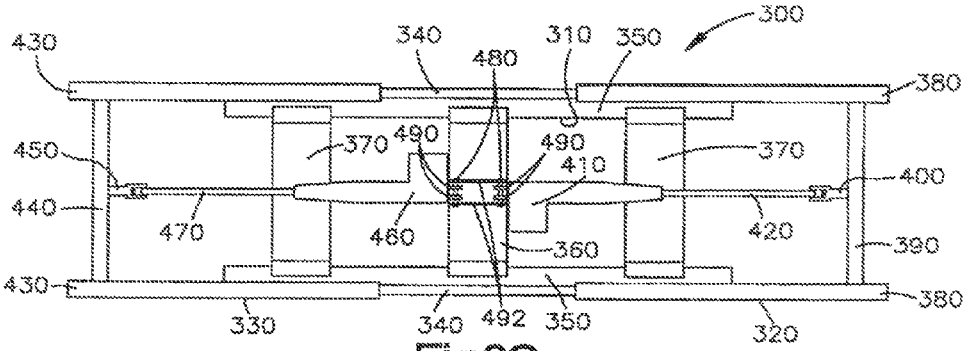

Automatically adjustable seat 100 includes a frame 300, which is shown in FIGS. 3A to 3C. The frame 300 includes a fixed portion 310, a first seat frame 320, and a second seat frame 330. The first seat frame 320 and second seat frame 330 are slideably attached to the fixed portion 310. The fixed portion 310 of the frame 300 includes rails 340 that are oriented parallel to each other. The rails 340 are supported by longitudinal members 350, an inner perpendicular cross member 360, and outer perpendicular cross members 370. The first seat frame 320 includes first seat frame parallel members 380 that are slideably attached to the rails 340. The first seat frame parallel members 380 are connected by a first seat frame parallel cross member 390. The first seat frame parallel cross member 390 includes a first seat frame adaptor 400 for connection to a first seat bottom portion automatic adjuster 410. The first seat bottom portion automatic adjuster 410 includes a first seat bottom portion automatic adjuster shaft 420 that is moveable by the first seat bottom portion automatic adjuster 410. The term automatic as used herein to describe an adjustor means the adjustor is capable of self-movement when an appropriate external signal is received, e.g., the adjustor moves an adjuster shaft upon a signal from a controller. The first seat bottom portion automatic adjuster shaft 420 is connected to the first seat frame adaptor 400. Similarly, the second seat frame 330 includes second seat frame parallel members 430 that are slideably attached to the rails 340. The second seat frame parallel members 430 are connected by a second seat frame parallel cross member 440. The second seat frame parallel cross member 440 includes a second seat frame adaptor 450 for connection to a second seat bottom portion automatic adjuster 460. The second seat bottom portion automatic adjuster 460 includes an second seat bottom portion automatic adjuster shaft 470 that is moveable by the second seat bottom portion automatic adjuster 460. The second seat bottom portion automatic adjuster shaft 470 is connected to the second seat frame adaptor 450. The first seat bottom portion automatic adjuster 410 and second seat bottom portion automatic adjuster 460 are connected to the frame 300 at the inner perpendicular cross member 360 by pins 470 inserted through matching adjuster channels 490 on the automatic adjusters and cross member channels 492 on the inner perpendicular cross member 360. The first seat bottom portion 140 includes is attached to the first seat frame 320 and the second seat bottom portion 160 is attached to the second seat frame 330.

The frame 300 is made from materials suitable for the environment and load expected to be placed on the frame 300. For example, the components of the frame 300 can be made from steel, aluminum, plastic, or combinations thereof. The first seat frame 320 and second seat frame 330 can be slideably attached to the rails 340 through the use, for example, of a bearing assembly. The first seat bottom portion automatic adjuster 410 and second seat bottom portion automatic adjuster 460 can be, for example, a pneumatic actuator, a hydraulic actuator, or an electric motor actuator. Further, the first seat bottom portion automatic adjuster 410 and second seat bottom portion automatic adjuster 460 can, for example, drive or actuate a shaft, rod, chain, or cable. The first seat bottom portion automatic adjuster shaft 420 and second seat bottom portion automatic adjuster shaft 470 can be, for example, a shaft or threaded rod depending on the mechanism of the first seat bottom portion automatic adjuster 410 and second seat bottom portion automatic adjuster 460. The fixed portion 310 of the frame 300 can be attached to a surface in a desired location.

Figure 4:
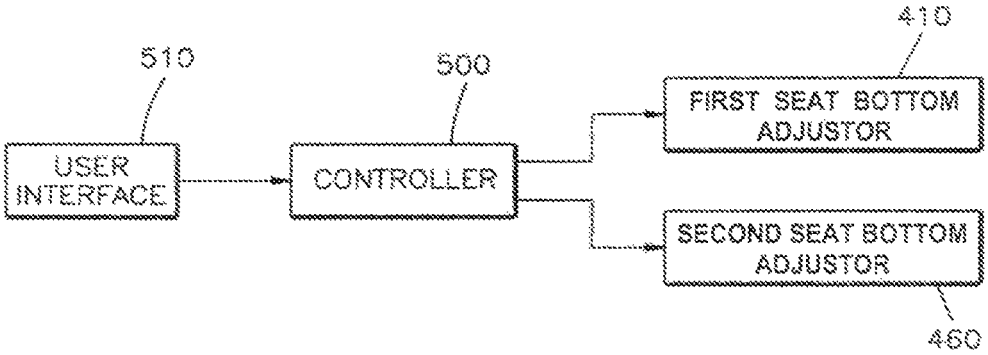
FIG. 4 is a schematic view of a control system for an automatically adjustable seating apparatus such as the automatically adjustable seating apparatus shown in FIGS. 1 and 2.

The first seat bottom portion automatic adjuster 410 and second seat bottom portion automatic adjuster 460 are operatively interconnected to a controller 500, shown in FIG. 4. The controller 500 has hardware and/or software configured for operation of these components 410 and 460, and may comprise any suitable programmable logic controller or other control device, or combination of control devices, that is programmed or otherwise configured to perform as recited in the claims. Specifically, the controller 500 controls the first seat bottom portion automatic adjuster 410 and second seat bottom portion automatic adjuster 460 to move the first seat bottom portion 140 and second seat bottom portion 160 between the retracted position and the extended position as shown in FIGS. 1 and 2. The controller 500 includes a user interface 510, which provides means for an operator to operate the automatically adjustable seat 100. The user interface 510 can be one or more devices with which a user can interact, such as, for example, switches, buttons, toggle switches, a computer controlled touch pad, or combinations thereof. The operation of the first seat bottom portion automatic adjuster 410 and second seat bottom portion automatic adjuster 460 can be controlled simultaneously, i.e., a single switch can be used to control the first seat bottom portion automatic adjuster 410 and second seat bottom portion automatic adjuster 460 to extend and retract. The controller 500 can provide a user with the ability to select one or more pre-selected positions for the automatically adjustable seating apparatus 100. Further, the controller 500 can provide a user with the ability to adjust the automatically adjustable seating apparatus 100 to maintain a position between the retracted and extended positions, such as a position shown in FIGS. 1B and 2B.

A second automatically adjustable seating apparatus 600 is shown in FIGS. 5A-C and FIGS. 6A-C. As shown, the second automatically adjustable seating apparatus 600 comprises a base portion 610, a first seat 620, and a second seat 630. The first seat 620 is formed by a first seat bottom portion 640 and a first seat back 650. The second seat 630 is formed by a second seat bottom portion 660 and a second seat back 670. The first seat bottom portion 640, the first seat back 650, second seat bottom portion 660, and second seat back 670 can be ergonomically shaped to adapt to the preference of a user or the intended environment in which the second automatically adjustable seating apparatus will be used. For example, the first seat back 650 and second seat back 670 could be high to provide head and neck support or low if such support is not needed in a particular application. Further, the first seat bottom portion 640, the first seat back 650, second seat bottom portion 660, and second seat back 670 can be made from materials suitable for the environment in which they will be used, i.e., if the automatically adjustable seating apparatus is to be used in a marine environment, materials resistant to degradation by water and/or salt can be used. For further example, the first seat bottom portion 640, the first seat back 650, second seat bottom portion 660, and second seat back 670 can be formed of shaped foam and covered with an outer covering material such as a vinyl, polyurethane, or fabric. The width of the second automatically adjustable seating apparatus 600 can vary from the width of a single seat to wide enough to seat several persons depending on the intended application. Additional components not shown in the drawings such as side bolsters can be utilized with the second automatically adjustable seating apparatus 600.

The first seat hack 650 has an upper portion 680 and a lower portion 690, and the first seat bottom portion 640 has a front portion 700 and a back portion 710. The lower portion 690 of the first seat back 650 is pivotally attached to the back portion 710 first seat bottom portion 640 along a first pivot attachment seam 720. The second seat back 670 also has an upper portion 730 and a lower portion 740, and the second seat bottom portion 660 also has a front portion 750 and a back portion 760. The lower portion 740 of the second seat back 670 is pivotally attached to the back portion 760 of the first seat bottom portion 660 along a second pivot attachment seam 770. The first seat back 650 is further pivotally attached at its upper portion 680 to the upper portion 730 of the second seat back 670 along a third pivot attachment seam 780. Each of the first pivot attachment seam 720, the second pivot attachment seam 770, and third pivot attachment seam 780 can comprise a pivot apparatus such as a single hinge or multiple hinges.

Figure 5A:
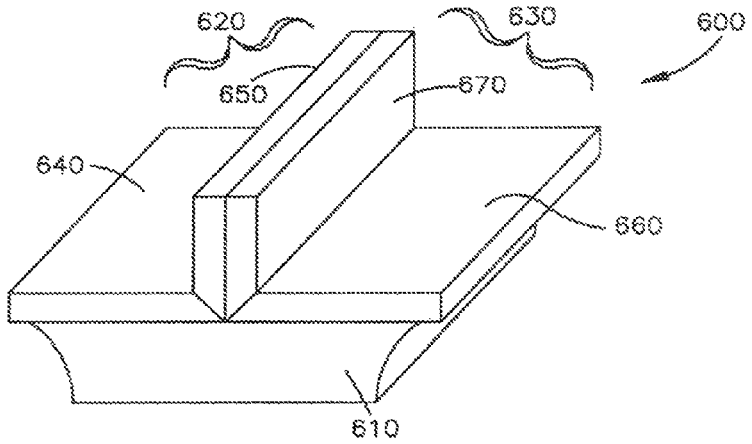
FIGS. 5A, 5B, and 5C are perspective views of an automatically adjustable seating apparatus configured as two seats back-to-back (FIG. 5A), in an intermediate position between a retracted position and an extended position (FIG. 5B), and configured as a substantially flat surface (FIG. 5C).
Figure 5B:
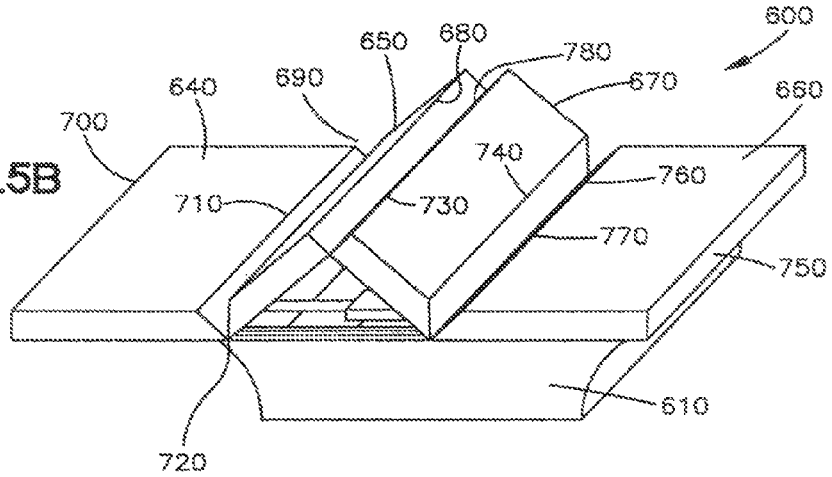
Figure 5C:
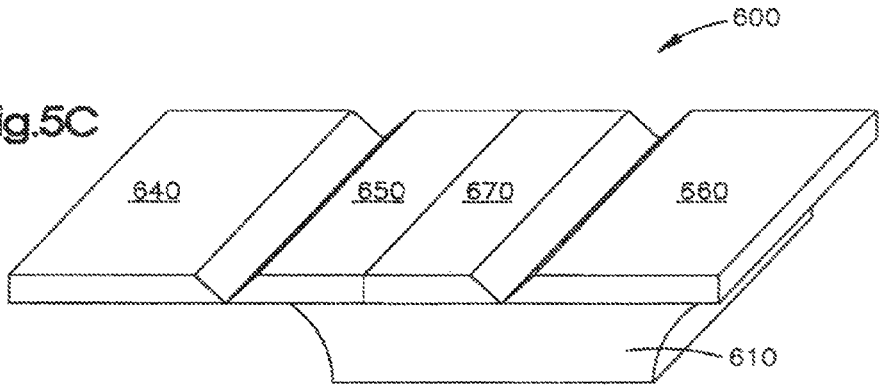
Figure 6A:
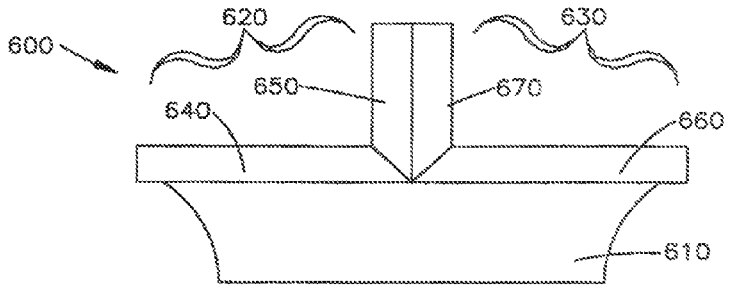
FIGS. 6A, 6B, and 6C are side views of an automatically adjustable seating apparatus configured as two seats back-to-back (FIG. 6A), in an intermediate position between a retracted position and an extended position (FIG. 6B), and configured as a substantially flat surface (FIG. 6C).
Figure 6B:
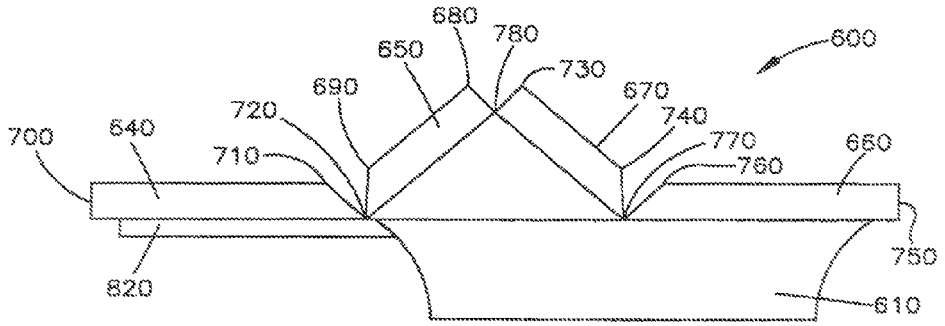
Figure 6C:
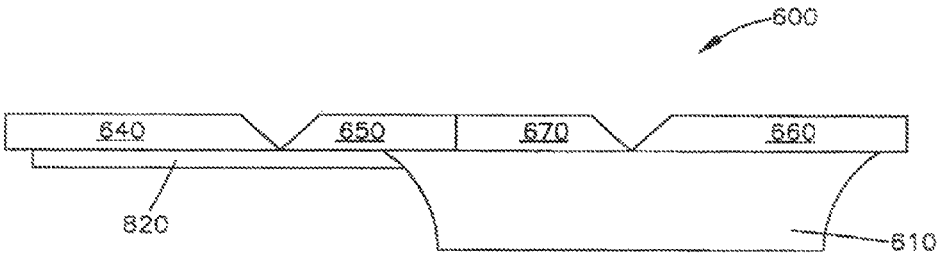

FIGS. 5A-C and 6A-C show the second automatically adjustable seating apparatus configured as two seats back-to-back (FIGS. 5A and 6A), in an intermediate position between a retracted position and an extended position (FIGS. 5B and 6B), and configured as a substantially flat surface (FIGS. 5C and 6C). The first seat bottom portion 640 is extendable between a first seat bottom portion retracted position and a first seat bottom portion extended position. The position of the second seat bottom portion 660 is fixed, the second seat bottom portion is not moved by an automatic adjuster. FIGS. 5A and 6A show the first seat bottom portion 640 in the first seat bottom portion retracted position, in which configuration the second automatically adjustable seating apparatus 600 is configured as two seats back-to-back. FIGS. 5C and 6C show the first seat bottom portion 640 in the first seat bottom portion extended position, in which configuration the second automatically adjustable seating apparatus 600 is configured as a substantially flat surface. FIGS. 5B and 6B show the first seat bottom portion 640 in a position between its retracted and extended positions. The first seat bottom portion 640 is automatically adjustable between its retracted and extended positions depending on the device used to adjust its position. The maintenance of positions of the first seat bottom portion 640 between its retracted and extended positions is contemplated depending on the preference of a user making the adjustment. For example, the positions shown in FIGS. 5B and 6B may be adopted by a user in order to recline rather than sit upright (first seat bottom portion 640 fully retracted) or substantially lie flat (first seat bottom portion 640 fully extended).

Figure 7A:
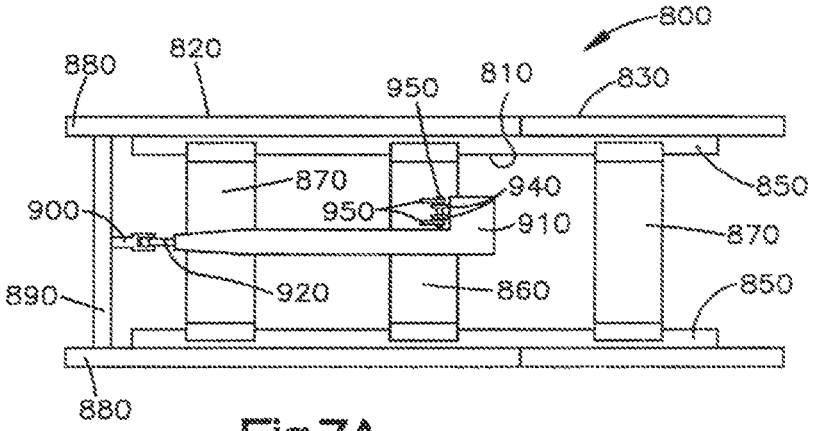
FIGS. 7A, 7B, and 7C are top views of a frame for use with the automatically adjustable seating apparatus shown in FIGS. 5 and 6 in the positions shown in FIGS. 5 and 6, i.e., with the automatically adjustable seating apparatus configured as two seats back-to-back (FIG. 7A), in an intermediate position between a retracted position and an extended position (FIG. 7B), and configured as a substantially flat surface (FIG. 7C).
Figure 7B:
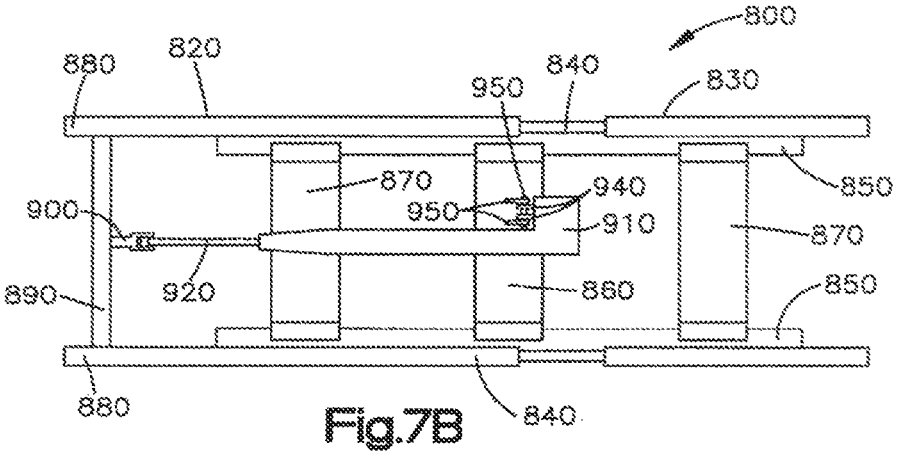
Figure 7C:
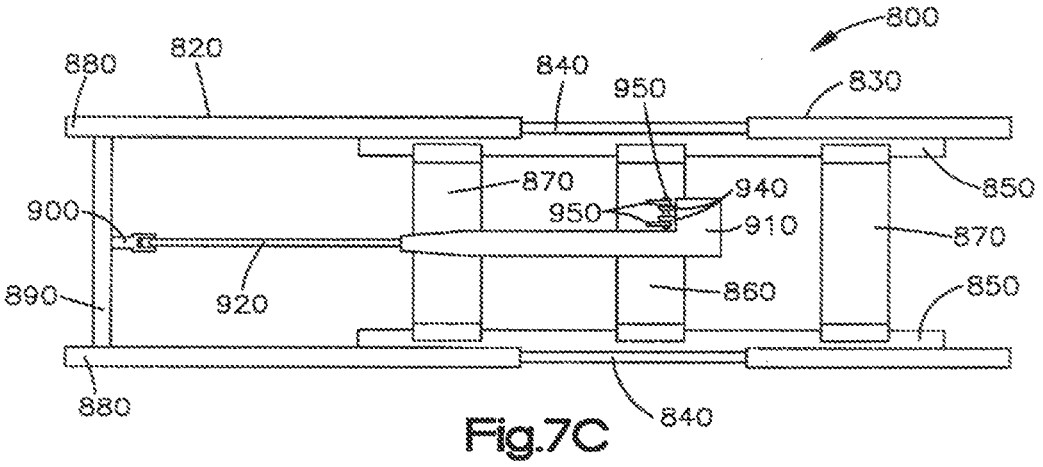

Second automatically adjustable seat 600 includes a frame 800, which is shown in FIGS. 7A to 7C. The frame 800 includes a fixed portion 810, a first seat frame 820, and a second seat frame 830. The first seat frame 820 is slideably attached to the fixed portion 810. The second seat frame 830 is fixedly attached to the fixed portion. The fixed portion 810 of the frame 800 includes rails 840 that are oriented parallel to each other. The rails 840 are supported by longitudinal members 850, an inner perpendicular cross member 860, and outer perpendicular cross members 870. The first seat frame 820 includes first seat frame parallel members 880 that are slideably attached to the rails 840. The length of the first seat frame parallel members 880 can be adjusted for example, related to the distance the first seat bottom portion 640 travels to achieve its fully extended position. The first seat frame parallel members 880 are connected by a first seat frame parallel cross member 890. The first seat frame parallel cross member 890 includes a first seat frame adaptor 900 for connection to a first seat bottom portion automatic adjuster 910. The first seat bottom portion automatic adjuster 910 includes a first seat bottom portion automatic adjuster shaft 920 that is moveable by the first seat bottom portion automatic adjuster 910. The first seat bottom portion automatic adjuster shaft 920 is connected to the first seat frame adaptor 900. The first seat bottom portion automatic adjuster 910 is connected to the frame 800 at the inner perpendicular cross member 860 by pin 930 inserted through a matching adjuster channel 940 on the automatic adjuster 910 and cross member channels 950 on the inner perpendicular cross member 860. The first seat bottom portion 640 is attached to the first seat frame 820 and the second seat bottom portion 660 is attached to the second seat frame 830.

The frame 800 is made from materials suitable for the environment and load expected to be placed on the frame 800. For example, the components of the frame 800 can be made from steel, aluminum, plastic, or combinations thereof. The first seat frame 820 can be slideably attached to the rails 840 through the use, for example, of a bearing assembly. The first seat bottom portion automatic adjuster 910 can be driven or actuated, for example, pneumatically, hydraulically, or by a motor. Further, the first seat bottom portion automatic adjuster 910 can, for example, drive or actuate a shaft, rod, chain, or cable. The first seat bottom portion automatic adjuster shaft 920 and can be, for example, a shaft or threaded rod depending on the mechanism of the first seat bottom portion automatic adjuster 910. The fixed portion 810 of the frame 800 can be attached to a surface in a desired location.

Figure 8:
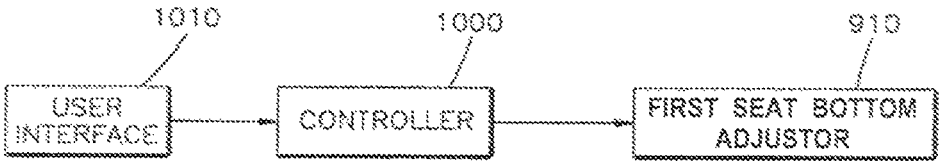
FIG. 8 is a schematic view of a control system for an automatically adjustable seating apparatus such as the automatically adjustable seating apparatus shown in FIGS. 5 and 6.

The first seat bottom portion automatic adjuster 910 of the second seat 600 is operatively interconnected to a controller 1000, shown in FIG. 8. The controller 1000 has hardware and/or software configured for operation of the first seat bottom portion automatic adjuster 910, and may comprise any suitable programmable logic controller or other control device, or combination of control devices, that is programmed or otherwise configured to perform as recited in the claims. Specifically, the controller 1000 controls the first seat bottom portion automatic adjuster 910 to move the first seat bottom portion 640 between its retracted position and extended position as shown in FIGS. 5 and 6. The controller 1000 includes a user interface 1010, which provides means for an operator to operate the second automatically adjustable seat 600. The user interface 1010 can be one or more devices as described above for user interface 510. The controller 1000 can provide a user with the ability to select one or more pre-selected positions for the second automatically adjustable seating apparatus 600. Further, the controller 1000 can provide a user with the ability to adjust the second automatically adjustable seating apparatus 600 to maintain a position between the retracted and extended positions, such as a position shown in FIGS. 5B and 6B.

As used herein, the terms substantially flat or substantially flat surface when applied to the surface of the seating apparatus are intended to mean a surface that is generally parallel or horizontal, i.e., not tilted or sloped. Such a substantially flat surface can be used, for example, for a person to lie down upon or to lay equipment upon. The frame of reference for a surface being generally parallel or horizontal can be, for example, a floor or the deck of a boat. In the example of a surface being parallel or horizontal with reference to the deck of a boat, in use the deck of a boat may not continually be horizontal, i.e., in use or in rough seas the boat may be in constant motion, but the surface will remain substantially flat, i.e., parallel or horizontal with reference to the deck of the boat. The positions of the automatically adjustable seating apparatus 100 shown in FIGS. 1C and 2C and the positions of the second automatically adjustable seating apparatus 600 shown in FIGS. 5C and 6C are considered to be substantially flat surfaces within the scope of this description and the claims.

The heights of the automatically adjustable seat bottom portion portion 110 and second automatically adjustable seat bottom portion portion 610 depend upon the desired height of the seating surface of the automatically adjustable seating apparatus 100 or second automatically adjustable seating apparatus 600, i.e., the height of the surface of the first seat bottom portion 140 and second seat bottom portion 160 of the automatically adjustable seating apparatus 100 or the height of the surface of the first seat bottom portion 640 and second seat bottom portion 660 of the second automatically adjustable seating apparatus 600. The base portion 110 of the automatically adjustable seating apparatus 100 and base portion 610 of the second automatically adjustable seating apparatus 600 could be set within a floor or deck if the automatically adjustable seat is mounted on a floor or deck.

The present invention is not limited in scope by the embodiments disclosed herein which are intended as illustrations of a few aspects of the invention and any embodiments which are functionally equivalent are within the scope of this invention. Various modifications of the apparatus and methods in addition to those shown and described herein will become apparent to those skilled in the art and are intended to fall within the scope of the appended claims. Further, while only certain representative combinations of the apparatus and method steps disclosed herein are specifically discussed in the embodiments above, other combinations of the apparatus components and method steps will become apparent to those skilled in the art and also are intended to fall within the scope of the appended claims. Thus a combination of components or steps may be explicitly mentioned herein; however, other combinations of components and steps are included, even though not explicitly stated. The term "comprising" and variations thereof as used herein is used synonymously with the term "including" and variations thereof and are open, non-limiting terms.

What is claimed is:

1. An automatically adjustable seating apparatus comprising:

a frame;

a first seat bottom portion slideably attached to the frame;

an automatic adjuster that is attached to the first seat bottom portion and that alters a position of the first seat bottom portion between a first seat bottom portion retracted position and a first seat bottom portion extended position, wherein the position is altered by the automatic adjuster independent of manual adjustment by a person; and a second seat bottom portion, a position of the second seat bottom portion being fixed, wherein when the first seat bottom portion is in its retracted position, the automatically adjustable seating apparatus is configured as two seats back-to-back, and when the first seat bottom portion is in its extended position, the automatically adjustable seating apparatus forms a substantially flat surface.

2. The automatically adjustable seating apparatus of claim 1, further comprising:

a first seat back having an upper portion and a lower portion, the lower portion pivotally attached to the first seat bottom portion; and a second seat back having an upper portion and a lower portion, the lower portion pivotally attached to the second seat bottom portion and the upper portion pivotally attached to the upper portion of the first seat back.

3. The automatically adjustable seating apparatus of claim 1, further comprising a controller operatively interconnected with the automatic adjuster for controlling the position of the first seat bottom portion, the first seat back and the second seat back, wherein the automatic adjuster includes at least one of an automatically driven or actuated adjuster.

4. The automatically adjustable seating apparatus of claim 3, wherein the controller is capable of adjusting the automatic adjuster to maintain a position between the retracted and extended positions.

5. The automatically adjustable seating apparatus of claim 3, wherein the controller has selectable pre-selected positions between the retracted and extended positions, and wherein the automatic adjuster is a motorized adjuster.

6. The automatically adjustable seating apparatus of claim 1, wherein the automatic adjuster is electrically driven.

7. The automatically adjustable seating apparatus of claim 1, wherein the first seat bottom portion is attached to a first seat frame and the first seat frame is slideably attached to the frame.

8. The automatically adjustable seating apparatus of claim 1, wherein the second seat bottom portion is attached to a second seat frame.

9. The automatically adjustable seating apparatus of claim 1, further comprising an intermediate position between the first seat bottom portion retracted position and the first seat bottom portion extended position.

10. An automatically adjustable seating apparatus comprising:

a frame;

a first seat bottom portion slideably attached to the frame;

an automatic adjuster that moves the first seat bottom portion between a retracted position and an extended position without manual adjustment of the first seat bottom portion by an operator;

a second seat bottom portion attached in a fixed position to the frame;

a first seat back having an upper portion and a lower portion, the lower portion pivotally attached to the first seat bottom portion; and a second seat back having an upper portion and a lower portion, the lower portion pivotally attached to the second seat bottom portion and the upper portion pivotally attached to the upper portion of the first seat back, wherein the first seat bottom portion is moveable from the retracted position to the extended position in a linear direction away from the second seat bottom portion a distance sufficient to allow the first and second seat backs to form a substantially flat surface.

11. The automatically adjustable seating apparatus of claim 10, further comprising a controller operatively interconnected with the automatic adjuster for controlling the position of the first seat bottom portion.

12. The automatically adjustable seating apparatus of claim 11, wherein the controller is capable of adjusting the automatic adjuster to maintain a position between the retracted and extended positions.

13. The automatically adjustable seating apparatus of claim 11, wherein the controller has selectable pre-selected positions between the retracted and extended positions.

14. The automatically adjustable seating apparatus of claim 10, wherein the automatic adjuster is electrically driven.

15. The automatically adjustable seating apparatus of claim 10, wherein the first seat bottom portion is attached to a first seat frame and the first seat frame is slideably attached to the frame.

16. The automatically adjustable seating apparatus of claim 10, further comprising an intermediate position between the first seat bottom portion retracted position and the first seat bottom portion extended position.

17. An automatically adjustable seating apparatus comprising:

a first seat bottom portion, the first seat bottom portion moveable by an automatic adjuster when an external signal is received to alter a position of the first seat bottom portion between a retracted position and an extended position;

a first seat back having an upper portion and a lower portion, the lower portion pivotally attached to the first seat bottom portion;

a fixed second seat bottom portion;

a second seat back having an upper portion and a lower portion, the lower portion pivotally attached to the second seat bottom portion and the upper portion pivotally attached to the upper portion of the first seat back; and a controller operatively interconnected with the automatic adjuster for controlling the position of the first seat bottom portion relative to the second seat bottom portion, wherein when the first seat bottom portion is in the retracted position the automatically adjustable seating apparatus is configured as two seats back-to-back, and when the first seat bottom portion is in the extended position the automatically adjustable seating apparatus forms a substantially flat surface.

18. An automatically adjustable seating apparatus comprising:

a frame;

a first seat comprising a first seat bottom that is pivotably attached to a first seat back, the first seat bottom slidable relative to the frame;

a second seat comprising a second seat bottom that is pivotably attached to a second seat back, the second seat back pivotably attached to the first seat back, the second seat bottom fixed relative to the frame; and a motorized automatic adjuster coupled to the first seat bottom, wherein activation of the motorized automatic adjuster drives the first seat bottom relative to the frame between a fully retracted position and a fully extended position without any manual pushing or pulling of the automatically adjustable seating apparatus, wherein while the first seat bottom is in the fully retracted position the automatically adjustable seating apparatus is configured as two seats back-to-back, and while the first seat bottom is in the fully extended position the automatically adjustable seating apparatus is configured as a substantially flat surface.

19. The automatically adjustable seating apparatus of claim 18, further comprising a controller with one or more switches for electrically activating the motorized automatic adjuster to drive the first seat bottom relative to the frame.

* * * * *